US010961634B2

(12) United States Patent
Özkaya et al.

(10) Patent No.: US 10,961,634 B2
(45) Date of Patent: Mar. 30, 2021

(54) METHOD FOR INCREASING CORROSION RESISTANCE OF A SUBSTRATE COMPRISING AN OUTERMOST CHROMIUM ALLOY LAYER

(71) Applicant: Atotech Deutschland GmbH, Berlin (DE)

(72) Inventors: Berkem Özkaya, Berlin (DE); Philipp Wachter, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 16/772,339

(22) PCT Filed: Dec. 11, 2018

(86) PCT No.: PCT/EP2018/084410
§ 371 (c)(1),
(2) Date: Jun. 12, 2020

(87) PCT Pub. No.: WO2019/121178
PCT Pub. Date: Jun. 27, 2019

(65) Prior Publication Data

US 2020/0378022 A1 Dec. 3, 2020

(30) Foreign Application Priority Data

Dec. 22, 2017 (EP) ..... 17209956

(51) Int. Cl.
*C25D 3/06* (2006.01)
*C25D 3/56* (2006.01)
*C25D 5/10* (2006.01)
*C25D 5/12* (2006.01)

(52) U.S. Cl.
CPC ..... *C25D 3/06* (2013.01)

(58) Field of Classification Search
CPC ... C25D 3/06; C25D 3/56; C25D 5/10; C25D 5/12
USPC ..... 205/176, 179
See application file for complete search history.

(56) References Cited

U.S. PATENT DOCUMENTS 2,986,498 A * 5/1961 Strauss ..... C25D 3/02 205/296
3,876,513 A 4/1975 Brown et al.
6,004,448 A 12/1999 Martyak
8,435,360 B2 5/2013 Dingwerth et al.
9,738,790 B2 8/2017 Hofmann et al.
2009/0114544 A1* 5/2009 Rousseau ..... C25D 3/10 205/243
2010/0243463 A1 9/2010 Herdman et al.
2013/0213813 A1 8/2013 Hingley et al.
2014/0284218 A1 9/2014 Sugawara et al.
2015/0252487 A1 9/2015 Mertens et al.

FOREIGN PATENT DOCUMENTS

EP 3147388 A1 3/2017
JP 2009235456 A 10/2009
JP 2010209456 A 9/2010
WO 2008151829 A1 12/2008
WO 2011147447 A1 12/2011
WO WO-2011147447 A1 * 12/2011 ..... C25D 5/36

OTHER PUBLICATIONS

PCT/EP2018/084410; PCT International Search Report and Written Opinion of the International Searching Authority dated Jan. 18, 2019.

* cited by examiner

*Primary Examiner* — Edna Wong
(74) *Attorney, Agent, or Firm* — Renner, Otto, Boisselle & Sklar, LLP

(57) ABSTRACT

Method for increasing corrosion resistance of substrate including an outermost chromium alloy layer, including (i) providing substrate comprising an outermost layer, the layer having color space defined by CIELAB with lightness L* of 79 or more, including oxygen and carbon, and including iron in amount up to 1 atom-%, (ii) providing an aqueous, acidic passivation solution, the solution including trivalent chromium ions, phosphate ions, one or more than one organic acid anion, (iii) contacting the substrate with the passivation solution and passing electrical current between the substrate as cathode and an anode in the passivation solution wherein a passivation layer is deposited onto the outermost layer, wherein in step (i) the outermost layer is electrolytically deposited from aqueous, acidic deposition composition, the composition including trivalent chromium ions, at least one organic acid comprising an isothiureido moiety and/or salts thereof, and chloride ions in amount of 0 wt-% to 0.1 wt-%.

15 Claims, No Drawings

METHOD FOR INCREASING CORROSION RESISTANCE OF A SUBSTRATE COMPRISING AN OUTERMOST CHROMIUM ALLOY LAYER

The present application is a U.S. National Stage Application based on and claiming benefit and priority under 35 U.S.C. § 371 of International Application No. PCT/EP2018/084410, filed 11 Dec. 2018, which in turn claims benefit of and priority to European Application No. 17209956.6 filed 22 Dec. 2017, the entirety of both of which is hereby incorporated herein by reference.

FIELD OF THE INVENTION

The present invention relates to a method for increasing resistance against acid rain caused corrosion of a substrate comprising an outermost chromium alloy layer obtained from trivalent chromium.

BACKGROUND OF THE INVENTION

Electrolytically deposited nickel and chromium layers on a metal substrate or plastic substrate are well known for decorative and functional purposes. It is also known that such substrates exhibit good and acceptable corrosion resistance, in particular if the outermost layer is obtained from hexavalent chromium.

However, hexavalent chromium, for example in chromic acid, is very toxic, carcinogen and an environmental hazard. In particular, waste water processing is very costly and requires a lot of effort. Therefore, it is desired to minimize the utilization of hexavalent chromium. As a result, outermost chromium layers obtained from hexavalent chromium, which typically exhibit a very good corrosion resistance and are manufactured by well-established procedures, are more and more replaced by outermost chromium layers obtained from trivalent chromium. Since then, there are ongoing efforts to optimize such chromium layers in order to arrive at properties being at least equivalent to chromium layers obtained from hexavalent chromium, for example in terms of corrosion resistance.

In order to optimize corrosion resistance of outermost chromium layers obtained from trivalent chromium, surface treatments such as immersion treatments and/or electrolytic passivation are typically applied.

US 2015/0252487 A1 relates to a method of imparting improved corrosion protection to chromium plated substrates, which have been plated with chromium from a $Cr^{+3}$ plating bath, claiming a method of treating a substrate, wherein the substrate comprises a plated layer comprising chromium deposited from a trivalent chromium electrolyte, the method comprising the steps of:

(a) providing an anode and the substrate as a cathode in an electrolyte comprising (i) a trivalent chromium salt; and (ii) a complexant;

(b) passing an electrical current between the anode and the cathode to deposit a passivate film on the substrate.

JP 2009-235456 A relates to (i) an electrolytic treatment solution for a chromium-plated film formed from a trivalent-chromium plating solution and (ii) a method for electrolytically treating a chromium-plated film formed from trivalent-chromium plating solution wherein the solution comprises a water-soluble trivalent chromium compound, for example chromium sulfate, basic chromium sulfate, chromium nitrate, chromium acetate, chromium chloride, and chromium phosphate. It discloses further that an article is electrolytically treated as a cathode.

JP 2010-209456 A relates to an immersion treatment solution for preventing rusting of a chromium-plated film, and to a method for performing a treatment to prevent rusting of a chromium-plated film (rust-preventing treatment method) in which the treatment solution is used wherein the method can be applied to a hexavalent chromium-plated film or a trivalent chromium-plated film.

WO 2008/151829 A1 relates to a method for creating an anticorrosive coating layer, wherein a surface to be treated is brought into contact with an aqueous treatment solution comprising chromium(III) ions and at least one phosphate compound, wherein the ratio of the concentration of the substance amount of chromium(III) ions to the concentration of the at least one phosphate compound (calculated in relation to orthophosphate) lies between 1:1.5 and 1:3. The method improves anticorrosive protection of metal surfaces, particularly metal surfaces containing zinc, provided with conversion layers. The chromium(III) ions are either provided by inorganic chromium(III) salts or by means of reducing suitable hexavalent chromium compounds.

WO 2011/147447 A1 relates to a process for producing essentially chromium(VI)-free corrosion protection layers on surfaces of zinc, aluminium or magnesium and also alloys of these metals. The surface to be treated is brought into contact in direct succession with two aqueous treatment solutions containing chromium(III) ions, metal ions of the substrate surface to be treated and at least one complexing agent. The first treatment solution has a pH in the range from 1.0 to 4.0, while the second treatment solution has a pH of from 3.0 to 12.0. Claim 12 discloses that the passivating treatment in step 1 is aided by connecting the substrate as cathode in the passivation solution.

U.S. Pat. No. 6,004,448 A relates to a soluble composition of matter and process for electrolytically depositing a chromium oxide coating on a metal substrate from a bath containing a trivalent chromium compound.

Metal corrosion is usually caused by various corrosive conditions and/or compounds. Typically, a substrate comprising an outermost chromium alloy layer responds differently to these various corrosive conditions and compounds. In many cases, a substrate and its outermost chromium alloy layer is not sufficiently protected against all sorts of corrosion.

For example, a well-known and aggressive type of environmental corrosion is caused by acid rain. Substrates comprising an outermost chromium alloy layer obtained from trivalent chromium and being naturally exposed to the environment, in particular articles utilized in automobiles, are typically susceptible to this particular type of corrosion. In a number of cases such outermost layers serve decorative purposes. Defects caused by corrosion quickly deteriorate the optical impression, and, thus, must be avoided to the best extent possible. However, in many cases this type of corrosion is not sufficiently suppressed. Furthermore, requirements in corrosion resistance are continually increasing in order to obtain long life times of respective goods. Thus, there is an ongoing demand to improve corrosion resistance; in the present case to increase corrosion resistance of outermost chromium alloy layers obtained from trivalent chromium against acid rain caused corrosion.

OBJECTIVE OF THE PRESENT INVENTION

It was therefore the objective of the present invention, based on the above mentioned prior art, to increase corrosion resistance of a substrate comprising an outermost chromium alloy layer obtained from trivalent chromium, especially resistance against acid rain caused corrosion of said substrate.

DESCRIPTION OF THE INVENTION

The above mentioned objective is solved by a method for increasing corrosion resistance of a substrate comprising an outermost chromium alloy layer, preferably for increasing resistance against acid rain caused corrosion of a substrate comprising an outermost chromium alloy layer, the method comprising the steps of (i) providing a substrate comprising said outermost layer, the layer
  having a color space defined by CIELAB with a lightness L* of 79 or more,
  comprising oxygen and carbon, and
  comprising iron in a total amount of 0 atom-% to 1 atom-%, based on the total number of atoms in said outermost layer, (ii) providing an aqueous, acidic passivation solution, the solution comprising
  trivalent chromium ions,
  phosphate ions,
  one or more than one organic acid residue anion, (iii) contacting the substrate with the passivation solution and passing an electrical current between the substrate as a cathode and an anode in the passivation solution such that a passivation layer is deposited onto the outermost layer, wherein in step (i) the outermost chromium alloy layer is electrolytically deposited from an aqueous, acidic deposition composition, the composition comprising
  trivalent chromium ions,
  at least one organic acid comprising an isothiureido moiety and/or salts thereof, and
  chloride ions in a total amount of 0 wt-% to 0.1 wt-%, based on the total weight of the deposition composition.

In the context of the present invention the words "trivalent chromium ions" refer to $Cr^{3+}$-ions in a free and complexed form.

Furthermore, in the context of the present invention, the term "at least" in combination with a particular value denotes (and is exchangeable with) this value or more than this value. For example, "at least 90 wt-%" denotes (and is exchangeable with) "90 wt-% or more than 90 wt-%". Similarly, "at least one" denotes (and is exchangeable with) "one, two, three or more than three".

An outermost chromium layer obtained from trivalent chromium is typically a chromium alloy layer, usually comprising alloying elements such as carbon and/or oxygen, in particular carbon. Own experiments have shown that the surprising benefit of the method of the present invention relies on the combination of two aspects. First, acid rain caused corrosion is significantly suppressed if the outermost chromium alloy layer is almost free of iron, i.e. in the context of the present invention, iron is present only in a total amount of 0 at-% to 1 at-%, based on the total number of atoms in said outermost chromium alloy layer. This is usually achieved by utilizing an aqueous, acidic deposition composition comprising trivalent chromium ions but no or almost no chloride ions. In such deposition compositions typically no iron compounds/iron ions are dissolved. Furthermore, such deposition compositions usually result in bright, glossy, shiny outermost layers, typically characterized by a color space defined by a CIELAB with a lightness L* of 79 or more. As shown in the experimental section, the surprising benefit of the method of the present invention does basically not occur for "dark" outermost chromium layers, typically comprising iron and being deposited from a chloride ion containing deposition composition. In the context of the present invention, "dark" denotes a lightness L* of significantly less than 79, defined by CIELAB, e.g. L* of 72 and significantly below. Second, said outermost chromium alloy layer is contacted with an aqueous, acidic passivation solution comprising trivalent chromium ions, phosphate ions, and one or more than one organic acid residue anion. Furthermore, the contacting is carried out electrolytically and a passivation of the outermost chromium alloy layer is obtained. This particular combination (bright outermost chromium alloy layer combined with said passivation) surprisingly provides an excellently increased corrosion resistance, in particular an excellently increased resistance against acid rain caused corrosion (for further details see experimental section below).

After step (iii) of the method of the present invention, a substrate with a passivated, bright outermost chromium alloy layer is obtained, providing significantly increased resistance against acid rain caused corrosion compared to a substrate with a bright outermost chromium alloy layer, which is not passivated and compared to a substrate with a "dark" outermost chromium alloy layer (with and without passivation layer; for details see the experimental section below in the text). Resistance against acid rain caused corrosion is typically evaluated by means of the Kesternich-test (see also experimental section).

In step (i) of the method of the present invention the substrate comprising the outermost chromium alloy layer (throughout the present text frequently abbreviated as "the outermost layer") is provided.

A method of the present invention is preferred, wherein in step (i) the outermost layer is (a) directly on a surface of a base-substrate to form the substrate as defined in step (i), or (b) a layer of a layer stack, the layer stack being on a surface of a base-substrate and preferably comprising one or more than one layer selected from the group consisting of nickel layer, nickel alloy layer, copper layer, copper alloy layer, and noble metal seed layer.

If the outermost layer is a layer of such a layer stack, the layer stack is on a surface of said base-substrate, wherein said base-substrate and said layer stack together form the substrate as defined in step (i) of the method of the present invention.

In some cases it is preferred that one or more than one layer in the layer stack (preferably a nickel or nickel alloy layer) additionally comprises non-conductive particles, preferably silicon dioxide particles and/or aluminium oxide particles.

The base-substrate is preferably a metal base-substrate or an organic base-substrate.

Preferably, the metal base-substrate comprises one or more than one metal selected from the group consisting of iron, magnesium, nickel, zinc, aluminium, and copper, preferably iron, copper, and zinc. More preferred are in many cases metal alloy base-substrates of the aforementioned metals.

Most preferred is a method of the present invention wherein the metal base-substrate is selected from the group consisting of steel substrates, zinc based die cast substrates, brass substrates, copper substrates, and aluminium substrates. Zinc based die cast substrates typically comprise more than one or all elements of zinc, aluminium, magnesium, and copper. Typical trade marks for such products are for example ZAMAC and Superloy.

Brass substrates with an outermost chromium alloy layer are in particular used in manufacturing sanitary equipment. Steel substrates and zinc based die cast substrates are typically used in a huge variety of articles and usually exhibit said outermost chromium alloy layer for decorative purposes.

In some cases a method of the present invention is preferred, wherein the outermost layer is directly on a surface of a base-substrate, wherein the base-substrate is a metal base-substrate, more preferably the metal base-substrate comprises iron, most preferably the metal base-substrate is a steel substrate. An outermost chromium alloy layer directly on a surface of a steel substrate typically exhibits very good tribological characteristics. In many cases it is desired to additionally increase the resistance against acid rain caused corrosion of such a substrate.

The method of the present invention is in particular beneficial if the base-substrate is a metal base-substrate, preferably a metal alloy base-substrate, more preferably each as defined above. However, the passivation layer obtained by the method of the present invention also protects an outermost chromium alloy layer deposited onto an organic base-substrate from acid rain caused corrosive damage and optical deterioration.

Preferably, the organic base-substrate is selected from the group consisting of plastics, more preferably selected from the group of plastics consisting of acrylnitril butadiene styrol (ABS), acrylnitril butadien styrol-polycarbonate (ABS-PC), polypropylene (PP), and polyamide (PA).

Organic base-substrates are also used for manufacturing sanitary equipment and a huge variety of articles utilized in the automotive industry, thereby mimicking metal or metal alloy base-substrates.

Typically, organic base-substrates are first rendered conductive by means of a seed layer for subsequent metallization. Such a seed layer is usually a metal layer deposited by electroless deposition. In the context of the present invention, such a seed layer belongs to the above mentioned layer stack. Preferably, the seed layer is a copper layer or a noble metal seed layer. A preferred noble metal seed layer is selected from the group consisting of palladium layer and silver layer.

In many cases the outermost layer is a layer of a layer stack, the layer stack being on the surface of the base-substrate, most preferably if the base-substrate is an organic base-substrate.

However, if the base-substrate comprises nickel or the layer stack comprises a nickel and/or nickel alloy layer it is preferred that the outermost layer in step (i) of the method of the present invention is on a copper or copper alloy layer. This might be beneficial to prevent leaching of nickel ions.

In many cases a method of the present invention is preferred, wherein the layer stack comprises a copper or copper alloy layer, and thereon one or more than one nickel or nickel alloy layer, and thereon said outermost layer as defined in step (i) of the method of the present invention. The base substrate is preferably a metal alloy base-substrate, more preferably containing zinc, or an organic base substrate, preferably as described above.

A method of the present invention is preferred, wherein the outermost layer has a maximum layer thickness of 600 nm or less, preferably 500 nm or less. Such a layer thickness is typical for decorative chromium alloy layers. In the method of the present invention it is preferred that the outermost layer is a decorative layer.

The Outermost Chromium Alloy Layer:

In step (i) of the method of the present invention, an outermost chromium alloy layer is present, comprising chromium, and oxygen and carbon as alloying elements. In the context of the present invention, an alloying element is an element that is co-deposited with chromium. Preferably, one or more than one further alloying element other than carbon and oxygen is comprised in the outermost layer. Preferably, the one or more than one further alloying element is selected from the group consisting of sulfur and nitrogen. In some cases a method of the present invention is preferred, wherein the total amount of the further alloying elements in the outermost chromium alloy layer is 5 atom-% or less, based on the total number of atoms in the outermost chromium alloy layer, preferably 4 atom-% or less, more preferably 3 atom-% or less, even more preferably 2 atom-% or less. In a few cases it is preferred that the outermost layer does not contain further alloying elements.

Very preferred is a method of the present invention, wherein in step (i) in the outermost layer carbon is present in a total amount in the range from 2 atom-% to 10 atom-%, based on the total number of atoms in the outermost layer, preferably in the range from 4 atom-% to 9 atom-%, more preferably in the range from 5 atom-% to 8 atom-%, even more preferably in the range from 6 atom-% to 7 atom-%. In contrast, an outermost chromium layer obtained from hexavalent chromium typically contains no carbon.

Preferred is a method of the present invention, wherein in step (i) in the outermost layer oxygen is present in a total amount in the range from 2 atom-% to 15 atom-%, based on the total number of atoms in the outermost layer, preferably in the range from 5 atom-% to 12 atom-%, more preferably in the range from 7 atom-% to 11 atom-%, even more preferably in the range from 8 atom-% to 10.5 atom-%.

Preferred is a method of the present invention, wherein in step (i) the outermost layer comprises sulfur, preferably in a total amount in the range from 0.3 atom-% to 3.0 atom-%, based on the total number of atoms in the outermost layer, preferably in the range from 0.4 atom-% to 2.5 atom-%, more preferably in the range from 0.6 atom-% to 1.5 atom-%. If the outermost layer comprises sulfur, preferably in an amount as defined above, the brightness of the outermost layer is positively affected. However, if the total amount of sulfur significantly exceeds 3.0 atom-% the brightness of the outermost layer is reduced and, additionally, turns into an undesired yellowish hue.

Preferred is a method of the present invention, wherein the total amount of alloying elements (including all atoms except chromium) in the outermost chromium alloy layer is 28 atom-% or less, based on the total number of atoms in the outermost chromium alloy layer, preferably 23.5 atom-% or less, more preferably 20.5 atom-% or less, even more preferably 18 atom-% or less.

Preferably, carbon, oxygen, and sulfur are the only alloying elements; except impurities from iron.

In the method of the present invention, in step (i) the outermost layer is almost free of iron, i.e. only little amounts, for example impurities, are tolerated (0 atom-% to 1 atom-%). This amount refers to all forms of iron including all possible oxidation states. Preferred is a method of the present invention, wherein in step (i) the outermost layer comprises iron in a total amount of 0 atom-% to 0.7 atom-%, based on the total number of atoms in said outermost layer, preferably 0 atom-% to 0.5 atom-%, more preferably 0 atom-% to 0.3 atom-%, even more preferably 0 atom-% to 0.2 atom-%, most preferably 0 atom-% to 0.1 atom-%, even most preferably 0 atom-% to 0.05 atom-%. Very most preferably, iron is not detectable. This preferably means that iron containing compounds and iron ions, respectively, are not comprised in the aqueous, acidic deposition composition. However, iron and iron containing compounds/ions, respectively, as impurities might be included in the outermost layer and aqueous, acidic deposition composition, respectively. These amounts are unintentionally added and/or unavoidable.

A method of the present invention is preferred, wherein in step (i) the outermost chromium alloy layer comprises chromium in a total amount of at least 72 atom-%, based on the total number of atoms in the outermost chromium alloy layer, preferably at least 76.5 atom-%, more preferably at least 79.5 atom-%, even more preferably at least 82 atom-%.

Preferred is a method of the present invention, wherein in step (i) the outermost chromium alloy layer comprises chromium, oxygen, carbon, and sulfur in a total amount of 95 atom-% or more, based on the total number of atoms in the outermost chromium alloy layer, preferably of 97 atom-% or more, more preferably of 98 atom-% or more, even more preferably of 99 atom-% or more, most preferably of 99.8 atom-% or more. Preferably, the outermost layer substantially consists of chromium, oxygen, carbon and sulfur.

In some cases a method of the present invention is preferred, wherein in step (i) the outermost chromium alloy layer is substantially free of, preferably does not comprise, phosphorous.

In the method of the present invention the outermost layer is a bright layer. As already mentioned above, in the method of the present invention, typically bright layers show a significantly increased resistance against acid rain caused corrosion. Thus, the lightness L* based on the CIELAB color space is 79 or more. Preferred is a method of the present invention, wherein in step (i) said outermost layer has a color space defined by CIELAB with a lightness L* of 80 or more, preferably of 81 or more, more preferably of 82 or more. For comparison reasons, an outermost layer obtained from hexavalent chromium typically has a L* value in the range from 84 to 85, and is usually considered as very shiny and glossy. Generally, a L* value of 0 (zero) corresponds to black, wherein a L* value of 100 corresponds to white.

In the context of the present invention the CIELAB color space (specified by the International Commission on Illumination) is determined by the parameters L*, a*, and b*, wherein L* ranges from 0 to +100.

Preferred is a method of the present invention, wherein in step (i) said outermost layer has a color space defined by CIELAB with a color channel a* and b* independently in the range from −5.0 to +5.0. Within this range the appearance of the outermost layer is mostly grey/grayish and has a chromium shade.

More preferred is a method of the present invention, wherein in step (i) said outermost layer has a color space defined by CIELAB with a color channel a* in the range from −2.0 to +2.0, preferably from −1.0 to +1.0, more preferably from −0.9 to +0.1, even more preferably from −0.9 to −0.1. Color channel a* describes the portion of red (positive values) and green (negative values), respectively.

More preferred is a method of the present invention, wherein in step (i) said outermost layer has a color space defined by CIELAB with a color channel b* in the range from −4.0 to +4.0, preferably from −2.0 to +3.0, more preferably from −0.5 to +2.0, even more preferably from −0.25 to +1.0. Color channel b* describes the portion of yellow (positive values) and blue (negative values), respectively. It is preferred that the color channel b* is negative because a slightly bluish hue is preferred compared to a slightly yellowish hue, obtained from a slightly positive color channel b*.

"Outermost chromium alloy layer" means that in step (i) no additional metal or metal alloy layer is deposited or present on said outermost layer. Preferably, no passivation layer (organic and/or inorganic) is present on said outermost layer in step (i). However, this does not exclude in the context of the present invention a cleaning step prior to step (iii). Furthermore, in some cases a method of the present invention is preferred, wherein a pre-treatment of the outermost chromium alloy layer prior to step (iii) is carried out (e.g. an immersion step). Preferred is a method of the present invention comprising prior to step (iii) the additional step (ii-a) immersing the substrate obtained after step (i) into an aqueous immersion treatment solution comprising
trivalent chromium ions,
phosphate ions,
one or more than one organic acid residue anion,
wherein during the immersing no electrical current is applied.

The aqueous immersion treatment solution (in the context of the present invention also simply abbreviated as the immersion solution) preferably has a pH in the range from 1 to 3, preferably 1 to 1.5, and comprises water-soluble trivalent chromium phosphate and phosphoric acid. The total concentration of trivalent chromium ions is in the range from 1 g/L to 50 g/L, based on the total volume of the aqueous immersion treatment solution, preferably from 8 g/L to 12 g/L. Optionally, the aqueous immersion treatment solution comprises a total concentration of 1 g/L to 100 g/L, based on the total volume of the aqueous immersion treatment solution, of one or more than one pH-buffering compound, preferably one or more than one water-soluble aliphatic organic acid, more preferably selected from the group consisting of formic acid, acetic acid, oxalic acid, malonic acid, succinic acid, gluconic acid, malic acid, citric acid, and water-soluble salts thereof, preferably sodium and/or potassium salts thereof. In some cases of the method of the present invention the substrate as defined in step (i) is preferably immersed into such an aqueous immersion treatment solution for 3 seconds to 120 seconds prior to step (iii), preferably for 5 seconds to 30 seconds. During immersion, the temperature of the aqueous immersion treatment solution is preferably in the range from 20° C. to 50° C., more preferably in the range from 21° C. to 35° C. After the pre-treatment it is preferred that the substrate is thoroughly rinsed with DI water.

Preferably, the immersion solution is different from the passivation solution, in particular, in the immersion solution the concentration of trivalent chromium ions is higher than in the passivation solution, likewise the concentration of phosphate ions. Furthermore, the pH of the immersion solution is preferably lower than of the passivation solution.

Besides a specific chemical composition, the outermost layer also has further specific physical characteristics. Preferably, the outermost layer in step (i) is free of cracks and free of pores. "free of pores" denotes that the number of pores is below 2000 pores/cm$^2$, preferably below 1000 pores/cm$^2$, more preferably below 500 pores/cm$^2$, most preferably below 200 pores/cm$^2$. The number of pores can be determined by known tests e.g. Dupernell Test or Cass Test. "free of cracks" denotes that the number of cracks is below 500/cm, preferably below 300/cm, more preferably below 200/cm.

The aqueous, acidic deposition composition:

In step (i) of the method of the present invention, the outermost layer is electrolytically deposited from an aqueous, acidic deposition composition comprising (throughout the present text frequently abbreviated as the deposition composition)

trivalent chromium ions, at least one organic (preferably carboxylic) acid comprising an isothiureido moiety and/or salts thereof, and chloride ions in a total amount of 0 wt-% to 0.1 wt-%, based on the total weight of the deposition composition.

The deposition composition is aqueous, which means that water is the primary solvent, preferably the only solvent. Thus, the at least one organic acid comprising an isothiureido moiety and salts thereof preferably denotes water-soluble compounds only. The pH is acidic, i.e. is preferably 6.5 or below. More preferred is a method of the present invention, wherein in step (i) the deposition composition has a pH in the range from 2.0 to 4.0, preferably in the range from 2.8 to 3.8, most preferably in the range from 3.2 to 3.6. The pH is referenced to 55° C.

Preferred is a method of the present invention, wherein the outermost layer is electrolytically deposited with a cathodic current density in the range from 2 A/dm$^2$ to 15 A/dm$^2$, preferably in the range from 3 A/dm$^2$ to 7 A/dm$^2$. However, in each case, the cathodic current density utilized to obtain the outermost layer is preferably higher than the cathodic current density utilized in step (iii) to obtain the passivation layer. If the current density significantly exceeds 15 A/dm$^2$ undesired hexavalent chromium is formed and in some cases anodes are damaged. If the current density is significantly below 2 A/dm$^2$ the outermost layer is incompletely deposited.

For electrolytically depositing the outermost layer at least one anode is required, preferably at least one inert anode, more preferably at least one anode selected from the group consisting of graphite anode, platinized titanium anode, platinum anode, platinum-coated titanium anode, and iridiumoxide-coated titanium anode, most preferably at least one anode selected from the group consisting of platinized titanium anode, platinum-coated titanium anode, and iridiumoxide-coated titanium anode.

The outermost chromium alloy layer is electrolytically deposited from an aqueous, acidic deposition composition (as described throughout the present text), preferably having a temperature in the range from 40° C. to 65° C. The electrolytic deposition is preferably carried out for 1 minute to 15 minutes, more preferably for 2 minutes to 12 minutes.

The trivalent chromium ions in the deposition composition are preferably from at least one trivalent chromium salt. Regarding trivalent chromium salts, there are no special restrictions unless chloride-containing trivalent chromium salts are avoided. Preferred trivalent chromium salts are selected from the group consisting of chromium sulfate (basic and/or acidic), chromium formate, and chromium acetate.

Preferred is a method of the present invention, wherein the trivalent chromium ions in the deposition composition are present in a total concentration in the range from 4 g/L to 25 g/L, based on the total volume of the deposition composition, more preferably in the range from 5 g/L to 15 g/L and most preferably in the range from 6 g/L to 12 g/L. Said total concentration is based on a molecular weight of 52 g/mol for chromium.

In the method of the present invention, the deposition composition comprises at least one organic acid comprising an isothiureido moiety and/or salts thereof ("isothiureido" is synonymously interchangeable with "isothioureido", which has identical meaning in the context of the present invention). In the context of the present invention, an isothiureido moiety is represented as follows: $(NR^1R^2)C(=NR^3)S—$, including salts thereof, wherein $R^1$ denotes hydrogen or alkyl, preferably hydrogen or a C1 to C4 alkyl, more preferably hydrogen, methyl, ethyl, isopropyl, n-propyl, n-butyl, or tert-butyl, $R^2$ denotes hydrogen or alkyl, preferably hydrogen or a C1 to C4 alkyl, more preferably hydrogen, methyl, ethyl, isopropyl, n-propyl, n-butyl, or tert-butyl, and $R^3$ denotes hydrogen or alkyl, preferably hydrogen or a C1 to C4 alkyl, more preferably hydrogen, methyl, ethyl, isopropyl, n-propyl, n-butyl, or tert-butyl.

Preferably, at least one of $R^1$, $R^2$, and $R^3$ is hydrogen, or at least one of $R^1$ and $R^2$ is hydrogen. More preferably all of $R^1$, $R^2$, and $R^3$ are hydrogen. The latter state is represented by the following isothiureido moiety: $(NH_2)C(=NH)S—$, which is most preferred. In the moiety, the "—" connected on one end to the sulfur atom S denotes the covalent bond to the rest of the organic acid.

Preferably, the isothiureido moiety is a terminal moiety.

In the deposition composition, the at least one organic acid comprising an isothiureido moiety and salts thereof is preferably represented by at least one compound of $A-(CH_2)_n—B$, and/or salts thereof, wherein A denotes the isothiureido moiety, preferably the isothiureido moiety as described above as being preferred, B is independently selected from COOH and $S(=O)_2—OH$, preferably is COOH, and n is an integer in the range from 1 to 10, preferably from 1 to 8, more preferably from 1 to 6, most preferably from 2 to 4. "Salts thereof" includes for example a deprotonated carboxylic group, wherein the proton is replaced by an alkali cation.

Preferably, the at least one organic acid comprising an isothiureido moiety and salts thereof preferably comprises at least one carboxylic acid comprising an isothiureido moiety and/or salts thereof, more preferably comprises only carboxylic acids comprising an isothiureido moiety and/or salts thereof. Thus, a respective method is preferred. More preferred is a method of the present invention, wherein in the aqueous, acidic deposition composition of step (i) the at least one organic acid comprising an isothiureido moiety and salts thereof comprises at least one mono-carboxylic acid comprising an isothiureido moiety and/or salts thereof, preferably comprises at least one mono-carboxylic acid comprising a terminal isothiureido moiety and/or salts thereof. Preferably, at least one of said at least one carboxylic acid, preferably as defined above, comprises in total 3 to 12 carbon atoms, more preferably 3 to 10 carbon atoms, even more preferably 3 to 8 carbon atoms, most preferably 3 to 6 carbon atoms. Even more preferably, each of said at least one carboxylic acid, preferably as defined above, comprises in total 3 to 12 carbon atoms, more preferably 3 to 10 carbon atoms, even more preferably 3 to 8 carbon atoms, most preferably 3 to 6 carbon atoms.

The deposition composition comprises at least one organic acid comprising an isothiureido moiety (preferably as described above, preferably described as being preferred) and/or salts thereof. Salts thereof include every ionic form, for example including a deprotonated carboxylic group, a deprotonated sulfonic acid group, and/or a protonated isothiureido moiety.

Preferred is a method of the present invention, wherein in the aqueous, acidic deposition composition of step (i) the at least one organic acid comprising an isothiureido moiety and salts thereof comprises the compound $(NH_2)C(=NH)S—(CH_2)_m—COOH$ and/or salts thereof, wherein m is an integer in the range from 1 to 10, preferably from 1 to 5, more preferably from 2 to 4.

More preferred is a method of the present invention, wherein in the aqueous, acidic deposition composition of step (i) the at least one organic acid comprising an isothiureido moiety and salts thereof comprises the compound $(NH_2)C(=NH)S—(CH_2)_3—COOH$ and/or salts thereof, preferably is the compound $(NH_2)C(=NH)S—(CH_2)_3—COOH$ and/or salts thereof. The aforementioned specific compound is known as beta-isothiureidopropionic acid (CAS 5398-29-8). This compound and salts thereof are most preferred because a very uniform and constant deposition rate is obtained compared to alternative compounds such as thiourea and/or thiosulfate (which typically result in a fluctuating and inharmonic deposition rate). Furthermore, an excellent brightness and stable, uniform appearance is obtained with compounds comprising an isothiureido moiety. Generally, compounds comprising an isothiureido moiety (i) provide a longer life time in the deposition composition compared to thiourea and thiosulfate, respectively, and (ii) are less sensitive to variations in their working concentration and less sensitive to impurities. Leaving the very narrow optimal working concentration of thiourea and thiosulfate quickly results in an undesired discoloration of a respective outermost layer.

Preferred is a method of the present invention, wherein in the aqueous, acidic deposition composition the at least one organic acid comprising an isothiureido moiety and salts thereof is present in a total amount in the range from 1 ppm to 500 ppm, based on the total weight of the deposition composition, preferably in the range from 2 ppm to 250 ppm, more preferably in the range from 3 ppm to 120 ppm, even more preferably in the range from 4 ppm to 60 ppm. The aforementioned total amount includes all organic acids comprising an isothiureido moiety and salts thereof. However, for the determination of the total amount, salts are considered in their non-charged/neutral form (i.e. the acidic group is protonated and the isothiureido moiety is not protonated; which also means that for example alkali metal cations are not considered). If the total concentration is below 1 ppm the required brightness is not obtained and acid rain caused corrosion is insufficiently suppressed. If the total concentration is significantly exceeding 500 ppm an undesired appearance and darker color is observed. Preferably, all organic acids comprising an isothiureido moiety and salts thereof are carboxylic acids comprising an isothiureido moiety and/or salts thereof, preferably in a total amount and as calculated as mentioned above.

Preferred is a method of the present invention, wherein in step (i) the aqueous, acidic deposition composition is substantially free of, preferably does not comprise, thiourea and thiosulfate. In the context of the present invention, the term "substantially free" of a subject-matter (e.g. a compound, a material, etc.) denotes that said subject-matter is not present at all or is present only in (to) a very little and undisturbing amount (extent) without affecting the intended purpose of the invention. For example, such a subject-matter might be added or utilized unintentionally, e.g. as unavoidable impurity. "Substantially free" preferably denotes 0 (zero) ppm to 50 ppm, based on the total weight of the deposition composition (if defined for said composition), or based on the total weight of the passivation solution (if defined for said solution), preferably 0 ppm to 25 ppm, more preferably 0 ppm to 10 ppm, even more preferably 0 ppm to 5 ppm, most preferably 0 ppm to 1 ppm. Zero ppm denotes that a respective subject-matter is not comprised, which is most preferred. In particular preferred is a method of the present invention, wherein in step (i) the aqueous, acidic deposition composition comprises thiourea in a total amount from 0 ppm to 1 ppm, based on the total weight of the deposition composition, preferably from 0 ppm to 0.5 ppm, more preferably from 0 ppm to 0.1 ppm, most preferably 0 ppm.

Preferred is a method of the present invention, wherein the deposition composition comprises no or only very little amounts of ammonium ions. Ammonium ions are typically included in deposition compositions comprising chloride ions. It is assumed that ammonium ions have a stabilizing effect in such compositions and avoid high current density burnings during the deposition process. However, ammonium ions are not desired in the deposition composition utilized in the method of the present invention. It is assumed that they reduce the deposition rate in an undesired manner. Furthermore, ammonium ions typically cause severe problems in waste water treatment. Therefore, preferred is a method of the present invention, wherein in step (i) the aqueous, acidic deposition composition comprises ammonium ions in a total amount in the range from 0 wt-% to 0.1 wt-%, based on the total weight of the deposition composition, preferably from 0 wt-% to 0.05 wt-%, more preferably from 0 wt-% to 0.03 wt-%, even more preferably from 0 wt-% to 0.01 wt-%, most preferably 0 wt-% to 0.005 wt-%.

Most preferred is a method of the present invention, wherein in step (i) the aqueous, acidic deposition composition does not comprise one, more than one or all of the compounds selected from the group consisting of thiourea, thiosulfate, and ammonium ions.

In the method of the present invention, the aqueous, acidic deposition composition comprises chloride ions in a total amount of 0 wt-% to 0.1 wt-%, based on the total weight of the deposition composition. This means that the presence of chloride ions is not desired. Preferred is a method of the present invention, wherein in step (i) the aqueous, acidic deposition composition comprises chloride ions in a total amount from 0 wt-% to 0.05 wt-%, based on the total weight of the deposition composition, preferably from 0 wt-% to 0.03 wt-%, more preferably from 0 wt-% to 0.01 wt-%, most preferably from 0 wt-% to 0.005 wt-%. As mentioned above, chloride ions are typically included in deposition compositions for "dark" outermost chromium layers. If the total amount of chloride ions is significantly exceeding 0.1 wt-%, an insufficient resistance against acid rain caused corrosion is obtained.

More preferred is a method of the present invention, wherein the aqueous, acidic deposition composition is substantially free of, preferably does not comprise, fluoride ions. Even more preferred is a method of the present invention, wherein the aqueous, acidic deposition composition is substantially free of, preferably does not comprise, compounds comprising fluorine.

More preferred is a method of the present invention, wherein the aqueous, acidic deposition composition is substantially free of, preferably does not comprise, bromide ions.

More preferred is a method of the present invention, wherein the aqueous, acidic deposition composition is substantially free of, preferably does not comprise, iodide ions.

In many cases, the aforementioned halides negatively affect the resistance against acid rain caused corrosion.

Preferred is a method of the present invention, wherein the aqueous, acidic deposition composition comprises saccharin, preferably in a total concentration in the range from 1 g/L to 10 g/L, based on the total volume of the deposition composition. Own experiments have shown that saccharin positively affects (i.e. increases) the brightness and the uniformity of the outermost layer.

As mentioned above, in the outermost layer the presence of iron is basically not desired. Thus, a method of the present invention is preferred, wherein the aqueous, acidic deposition composition is substantially free of, preferably does not comprise, iron ions. This includes iron ions in all oxidation numbers. Typically, iron ions contribute to a significant darkening of the outermost layer, which is not desired in the context of the present invention.

Preferred is a method of the present invention, wherein the aqueous, acidic deposition composition is substantially free of, preferably does not comprise, compounds or ions comprising hexavalent chromium. Thus, environmental and health issues are strongly reduced.

Preferred is a method of the present invention, wherein the aqueous, acidic deposition composition is substantially free of, preferably does not comprise, cobalt ions and nickel ions. Own experiments have shown that such ions negatively affect (i.e. reduce) the brightness of the outermost layer. Hence, the outermost layer is preferably substantially free of, preferably does not comprise, nickel and/or cobalt.

Preferred is a method of the present invention, wherein the aqueous, acidic deposition composition additionally comprises one, two, three or all of:

- at least one (preferably one) complexing agent for trivalent chromium ions, preferably selected from the group consisting of carboxylic acids and salts thereof, and amino acids and salts thereof; each not comprising an isothiureido moiety,
- at least one (preferably one) pH buffering compound,
- at least one (preferably one) conducting salt free of chloride ions, preferably sodium and/or potassium salts, and
- at least one (preferably one) surfactant, preferably selected from the group consisting of cationic surfactants and anionic surfactants.

Very preferred is a method of the present invention, wherein the deposition composition comprises said at least one (preferably one) complexing agent for trivalent chromium ions, preferably selected from the group consisting of carboxylic acids and salts thereof, and amino acids and salts thereof; each not comprising an isothiureido moiety. Typically, complexing agents, in particular carboxylic acids, significantly contribute to the carbon and oxygen content in the outermost chromium alloy layer.

Preferred carboxylic acids and salts thereof as complexing agents for trivalent chromium ions are selected from the group consisting of formic acid, acetic acid, citric acid, malic acid, and salts thereof.

All complexing agents for trivalent chromium ions (i.e. except all organic acids comprising an isothiureido moiety and salts thereof) are preferably present in a total concentration in the range from 5 g/L to 35 g/L, based on the total volume of the deposition composition, more preferably from 6 g/L to 25 g/L, most preferably from 7 g/L to 20 g/L. Preferably, the total concentration of these complexing agents is significantly higher than the total amount of the organic acids comprising an isothiureido moiety and salts thereof. In the context of the present invention, the total amount of organic acids comprising an isothiureido moiety and salts thereof is typically insufficient for significantly complexing the total amount of trivalent chromium ions.

Preferred pH buffering compounds are selected from the group consisting of boric acid and salts thereof, carboxylic acids and salts thereof, amino acids and salts thereof, and aluminium sulfate. In many cases it is preferred that the same compound serves as complexing agent for trivalent chromium ions and pH buffering agent. If boric acid and salts thereof are used as pH buffering compound, their total concentration is preferably in the range from 40 g/L to 80 g/L, based on the total volume of the deposition composition.

Preferred conducting salts comprise sulfate ions.

Preferred surfactants are selected from the group consisting of sulphosuccinates, alkyl benzene sulfonates, alkyl sulfates, alkyl ether sulfates, and fatty alcohols. Preferably, the total concentration of all surfactants is in the range from 0.001 g/L to 0.1 g/L, based on the total volume of the deposition composition.

The aqueous, acidic passivation solution:

In step (ii) of the method of the present invention, the aqueous, acidic passivation solution is provided (throughout the present text frequently abbreviated as the passivation solution). The term "providing" refers to an aqueous, acidic passivation solution ready for utilization in step (iii) of the method of the present invention.

In the passivation solution water is the primary solvent, preferably the only solvent.

In the method of the present invention the trivalent chromium ions in the aqueous, acidic passivation solution are obtained by chemically reducing hexavalent chromium or by dissolving at least one trivalent chromium salt. In some cases it is preferred that the trivalent chromium ions are obtained by dissolving at least one trivalent chromium salt, preferably at least one water-soluble trivalent chromium salt, because such a passivation solution provides very good increased resistance against acid rain caused corrosion. There are no special restrictions regarding which salts can be utilized. However, preferred water-soluble trivalent chromium salts are selected from the group consisting of chromium sulfate (basic and/or acidic), chromium chloride, chromium formate, and chromium acetate. However, in other cases it is preferred that the trivalent chromium ions are obtained by chemically reducing hexavalent chromium because an impressive corrosion resistance in the Neutral Salt Spray Tests (NSST) is observed additionally to the increased resistance against acid rain caused corrosion.

Preferred is a method of the present invention, wherein the pH of the aqueous, acidic passivation solution is in the range from 3.0 to 5.0, preferably 3.1 to 4.0, more preferably 3.3 to 3.9. The pH is referenced to 20° C. If the pH is significantly above 5.0, an undesired precipitation is observed in the passivation solution. If the pH is significantly below 3.0, an insufficient resistance against acid rain caused corrosion is obtained. Preferably, the above mentioned pH-range is obtained and/or maintained by adding a hydroxide, preferably sodium hydroxide, and phosphoric acid, respectively.

Preferred is a method of the present invention, wherein the total concentration of trivalent chromium ions in the aqueous, acidic passivation solution is in the range from 0.1 g/L to 50 g/L, based on the total volume of the aqueous, acidic passivation solution, preferably 1 g/L to 25 g/L, more preferably 1 g/L to 10 g/L, even more preferably 1 g/L to 7 g/L, most preferably 2 g/L to 7 g/L. Said total concentration is based on a molecular weight of 52 g/mol for chromium.

If the total concentration of trivalent chromium ions is significantly below 0.1 g/L, no passivation effect is observed. If the total concentration significantly exceeds 50 g/L undesired changes in the optical appearance of the outermost layer, such as stains and blurs, are frequently observed. Furthermore, above 50 g/L, the passivation process is usually no longer cost efficient.

Preferred is a method of the present invention, wherein the total concentration of phosphate ions in the aqueous, acidic passivation solution is in the range from 1 g/L to 90 g/L, based on the total volume of the passivation solution, preferably 2 g/L to 50 g/L, more preferably 5 g/L to 40 g/L, most preferably 8 g/L to 30 g/L. Said total concentration is based on a molecular weight of 95 g/mol for phosphate ions ($PO4^{3-}$). In the aqueous, acidic passivation solution utilized in the method of the present invention, phosphate ions preferably form complexes with trivalent chromium ions or at least are protonated according to the acidic pH of the aqueous, acidic passivation solution (e.g. $H_2PO_4^-$ at pH 3.5).

In step (ii), the aqueous, acidic passivation solution comprises one or more than one, preferably only one, organic acid residue anion, most preferably for complexing purposes. In the aqueous, acidic passivation solution the one or more than one organic acid residue anion is protonated (i.e. is present as the respective organic acid) or deprotonated (i.e. is present as the respective organic acid residue anion), depending on the solution's pH, the acid dissociation constant of the respective organic acid, and the complexes including said organic acid residue anions. If the organic acid residue anion is an organic acid residue anion with more than one carboxylic group, the anion may be partly protonated/deprotonated, respectively.

Preferred is a method of the present invention, wherein the one or more than one organic acid residue anion in the aqueous, acidic passivation solution is

- selected from the group consisting of organic acid residue anions having one carboxylic moiety, organic acid residue anions having two carboxylic moieties, and organic acid residue anions having three carboxylic moieties,
- preferably selected from the group consisting of organic acid residue anions having two carboxylic moieties,
- more preferably anions from organic acids selected from the group consisting of oxalic acid, malonic acid, succinic acid, glutaric acid, malic acid, and tartaric acid,
- most preferably oxalate.

Most preferred is a method of the present invention, wherein the one or more than one organic acid residue anion in the aqueous, acidic passivation solution of step (ii) comprises at least one organic acid residue anion having two carboxylic moieties, preferably comprises at least one organic acid residue anion having in total 2 to 8 carbon atoms and two carboxylic moieties, more preferably at least one organic acid residue anion having in total 2 to 6 carbon atoms and two carboxylic moieties, most preferably comprises at least one organic acid residue anion having in total 2 to 4 carbon atoms and two carboxylic moieties.

Preferred is a method of the present invention, wherein the total concentration of the one or more than one organic acid residue anion in the aqueous, acidic passivation solution is in the range from 1 g/L to 30 g/L, based on the total volume of the aqueous, acidic passivation solution, preferably 2 g/L to 14 g/L, more preferably 6 g/L to 12 g/L. The total concentration is determined based on the fully protonated, non-complexed, monomeric form of the corresponding organic acid. If the total amount is significantly below 1 g/L, no sufficient passivation effect is observed. If the total amount significantly exceeds 30 g/L, undesired changes in the optical appearance of the outermost layer, such as stains and blurs, are sometimes observed as well as an insufficient passivation effect.

Preferred is a method of the present invention, wherein in step (ii) the aqueous, acidic passivation solution is substantially free of, preferably does not comprise, hexavalent chromium compounds, preferably is substantially free of, preferably does not comprise, hexavalent chromium compounds and aluminium compounds, more preferably is substantially free of, preferably does not comprise, hexavalent chromium compounds, aluminium compounds, molybdenum compounds, vanadium compounds, and mercury compounds. According to own experiments it is assumed that aluminium compounds, molybdenum compounds, vanadium compounds, and mercury compounds may negatively interfere with the method for determining and analyzing hexavalent chromium in the passivation solution. In some cases, the passivation solution is preferably substantially free of, preferably does not comprise, molybdenum, tungsten, and ions of elements of group 7 (e.g. manganese) to group 12 (e.g. zinc) of the periodic system of elements. It is more preferred that the passivation solution is substantially free of, preferably does not comprise, copper ions, zinc ions, nickel ions, and iron ions. Hexavalent chromium is preferably determined and analyzed (including its quantification) by means of the commonly known diphenylcarbazide method.

Preferred is a method of the present invention, wherein the aqueous, acidic passivation solution is substantially free of, preferably does not comprise, boric acid, preferably is substantially free of, preferably does not comprise, boron containing compounds.

Preferred is a method of the present invention, wherein the aqueous, acidic passivation solution is substantially free of, preferably does not comprise, thiocyanate, preferably is substantially free of, preferably does not comprise, sulfur containing compounds comprising a sulfur atom having an oxidation state below +6. However, this means that the passivation solution for example may contain sulfate ions (oxidation state of +6), for example as anion of a conductive salt (see text below).

Preferred is a method of the present invention, wherein the aqueous, acidic passivation solution comprises one or more than one conductive salt. Preferably, the conductivity of the passivation solution is in the range from 1 mS/cm to 30 mS/cm, determined at 25° C. The one or more than one conductive salt is preferably selected from the group consisting of sulfate containing salts, nitrate containing salts, and perchlorate containing salts. Most preferably, the cation of the one or more than one conductive salt is sodium. Thus, most preferably the one or more than one conductive salt is selected from the group consisting of sodium sulfate, sodium nitrate, and sodium perchlorate. In some cases a method of the present invention is preferred, wherein the cation is not selected from the group consisting of potassium, ammonium, and magnesium, more preferably is not selected from the group consisting of potassium, ammonium, magnesium, calcium, strontium, and barium, most preferably is not selected from the group consisting of potassium, ammonium, and alkaline earth metals. This means that the passivation solution in the method of the present invention preferably does not comprise cations selected from the group consisting of potassium, ammonium, and magnesium, more preferably does not comprise cations selected from the group consisting of potassium, ammonium, magnesium, calcium, strontium, and barium, most preferably does not comprise cations selected from the group consisting of potassium, ammonium, and alkaline earth metals. The above mentioned conductivity is preferred because in step (iii) the voltage-operating window of the passivation solution can be maintained comparatively low and, thus, rectifiers with a comparatively small voltage-operating window can be utilized, which is cost efficient. Preferably, the total concentration of conductive salts in the passivation solution is in the range from 0 g/L to 30 g/L, based on the total volume of the passivation solution, more preferably in the range from 1 g/L to 28 g/L.

According to own experiments, potassium cations and alkaline earth metal ions in a number of cases caused undesired precipitation in a respective passivation solution. In experiments with ammonium cations in a respective passivation solution it was sometimes observed that after step (iii) in some cases the optical appearance of the outermost layer was negatively affected and stains or blurs occurred.

In step (iii) of the method of the present invention the substrate (operated as cathode) is contacted with the passivation solution (preferably by immersing the substrate into the passivation solution) and an electrical current is passed between the substrate and the anode (the anode is also typically immersed into the passivation solution) such that a passivation layer is deposited onto the outermost layer.

Preferred is a method of the present invention, wherein in step (iii) the anode is selected from the group consisting of mixed metal oxide coated anodes, graphite anodes, and steel anodes, most preferably mixed metal oxide coated anodes. In particular preferred are insoluble anodes such as mixed metal oxide coated anodes. According to own experiments, in the method of the present invention, mixed metal oxide coated anodes exhibit a comparatively low rate of anodic oxidation of trivalent chromium to undesired hexavalent chromium. Preferably, the method of the present invention is carried out in such a way that the total amount of hexavalent chromium in the aqueous, acidic passivation solution (if at all anodically formed in step (iii)) remains below detection level while the method of the present invention is carried out (for detecting hexavalent chromium see text above). This can be achieved by using said mixed metal oxide coated anodes. Preferred mixed metal oxide coated anodes comprise one or more than one oxide selected from the group consisting of titanium oxide, iridium oxide, ruthenium oxide, and platinum oxide.

The electrical current in step (iii) is preferably a direct current, more preferably not including pulses. However, this current as well as the total concentration of trivalent chromium ions in the passivation solution is not sufficient to deposit metallic chromium in step (iii) onto the outermost layer. This means that the passivation layer is not an additional metallic chromium layer but rather a layer of compounds containing trivalent chromium.

Preferred is a method of the present invention, wherein in step (iii) the electrical current is passed with a cathodic current density in the range from 0.1 to 5 A/dm$^2$, preferably 0.1 to 4 A/dm$^2$, more preferably 0.2 to 3 A/dm$^2$, most preferably 0.3 to 2 A/dm$^2$. If the current density is significantly below 0.1 A/dm$^2$ no sufficient passivation effect is obtained. If the current density significantly exceeds 8 A/dm$^2$ undesired changes in the optical appearance of the outermost layer, such as stains and blurs, are sometimes observed and are accompanied by an insufficient passivation effect.

Preferred is a method of the present invention, wherein in step (iii) the electrical current is passed for 10 to 300 seconds, preferably 12 to 240 seconds, more preferably 15 to 120 seconds, most preferably 20 to 60 seconds. If the length of time is significantly below 10 seconds no sufficient passivation effect is obtained. If the length of time significantly exceeds 300 seconds undesired changes in the optical appearance of the outermost layer, such as stains and blurs, are observed in some cases.

Preferred is a method of the present invention, wherein in step (iii) the temperature of the passivation solution is in the range from 20° C. to 40° C., preferably 22° C. to 30° C. If the temperature significantly exceeds 40° C. undesired changes in the optical appearance of the outermost layer, such as stains and blurs, are sometimes observed and are accompanied by an insufficient passivation effect. Furthermore, undesired precipitation might occur.

Preferably, the passivation layer obtained after step (iii) has a maximum layer thickness of 4 nm or less, more preferably of 3 nm or less, most preferably of 2 nm or less.

Furthermore, the passivation layer is transparent and does not affect the color or brightness of the outermost layer.

The invention is further explained by the following non-limiting examples.

EXAMPLES

All experimental examples are summarized in the following Table. Additional explanations are given below.

| No. | Substrate | Deposition composition (DC) | Outermost layer (OuL) | Immersion solution (IS) | Passivation solution (PS) | Kesternich test result |
|---|---|---|---|---|---|---|
| Comparative examples | | | | | | |
| 1 | BRASS | DC1 | OuL1 | — | — | failed |
| 2 | BRASS | DC1 | OuL1 | — | PS2 | failed |
| 3 | BRASS | DC1 | OuL1 | IS | PS1 | failed |
| 4 | BRASS | DC1 | OuL1 | IS | PS2 | failed |
| 5 | ABS | DC1 | OuL1 | — | — | failed |
| 6 | ABS | DC1 | OuL1 | — | PS2 | failed |
| 7 | ABS | DC1 | OuL1 | IS | PS2 | failed |
| 8 | BRASS | DC2 | OuL2 | — | — | failed |
| 9 | ABS | DC2 | OuL2 | — | — | failed |
| Examples according to the invention | | | | | | |
| 10 | BRASS | DC2 | OuL2 | — | PS2 | passed |
| 11 | BRASS | DC2 | OuL2 | * | PS1 | passed |
| 12 | BRASS | DC2 | OuL2 | IS | PS2 | passed |

-continued

| No. | Substrate | Deposition composition (DC) | Outermost layer (OuL) | Immersion solution (IS) | Passivation solution (PS) | Kesternich test result |
|---|---|---|---|---|---|---|
| 13 | BRASS | DC2 | OuL2 | IS | PS1 | passed |
| 14 | ABS | DC2 | OuL2 | — | PS2 | passed |
| 15 | ABS | DC2 | OuL2 | IS | PS2 | passed |

No. refers to the respective experiment number.

* denotes a contacting with only phosphoric acid at 28° C.

Step (i), Providing a Substrate Comprising an Outermost Chromium Alloy Layer:

BRASS denotes a specimen (e.g. a plate or tube) made of brass, which is a preferred metal alloy base-substrate in the context of the present invention. Each base-substrate was first cleansed at room temperature in a sequence of cleaning solutions to obtain a cleansed base-substrate. After cleaning, the cleansed base-substrate was activated in an acidic solution (UniClean 675, Atotech) at room temperature for 30 seconds. After activation, a bright nickel layer was deposited on the activated base-substrate (Supreme Plus, Atotech) for approximately 20 minutes at 4 A/dm$^2$. Afterwards, the base-substrate with the bright nickel layer was activated in an acidic solution (UniClean 675, Atotech) for further depositing the outermost chromium alloy layer. Thus, the outermost chromium alloy layer is a layer of a two layer stack on the surface of the base-substrate.

ABS denotes a specimen (e.g. a plate) made of acrylnitril butadiene styrol (ABS), which is a preferred organic base-substrate in the context of the present invention. Each base-substrate was first cleansed at 50° C. to obtain a cleansed base-substrate. After cleaning, the cleansed base-substrate was etched by chromosulfuric acid, subsequently subjected to reduction and activation with palladium. In a sequence of steps, layers of electroless nickel, electroless copper, and electrolytic copper were deposited. Prior to the deposition of the outermost chromium alloy layer, a bright nickel layer was deposited for approximately 20 minutes at 4 A/dm$^2$. Afterwards, the base-substrate with the bright nickel layer was activated in an acidic solution (UniClean 675, Atotech) for further depositing the outermost chromium alloy layer. Thus, the outermost chromium alloy layer is a layer of a multi-layer stack on the surface of the base-substrate.

Deposition composition DC1 denotes a composition for comparison examples comprising 22 g/L trivalent chromium ions, 12 wt-% chloride ions, and 80 ppm iron ions. Furthermore, DC1 comprises boric acid, ammonium ions, and a mono-carboxylic acid. The pH is in the range from 2.7 to 3.0.

Deposition composition DC2 denotes a composition for examples according to the present invention comprising 9 g/L trivalent chromium ions, 0 wt-% chloride ions, 0 wt-% ammonium ions, and $(NH_2)C(=NH)S—(CH_2)_3—COOH$ in a total concentration in the range from 4 ppm to 60 ppm. Furthermore, DC2 comprises boric acid, Saccharin, and a dicarboxylic acid. The pH is in the range from 3.4 to 3.6.

Outermost layer OuL1 (comparative examples) denotes an outermost chromium alloy layer having a color space defined by CIELAB with a lightness L* significantly below 79, in this particular examples in the range from 72.3 to 73.5. The color channel a* was around zero, i.e. in the range from −0.02 to +0.03, and b* in the range from +1.5 to +1.9. In the context of the present invention, such an outermost layer is not sufficiently bright compared to a bright outermost chromium alloy layer with L* of 79 or more. OuL1 comprises, based on the total number of atoms in the outermost layer, 80 atom-% to 85 atom-% chromium, 4 atom-% to 9 atom-% carbon, 5 atom-% to 11.5 atom-% oxygen, approximately 5 atom-% iron, and 0 atom-% sulfur. OuL1 is obtained from deposition composition DC1 (35° C., 10 A/dm$^2$, 1.5 minutes).

Outermost layer OuL2 (examples according to the invention) denotes an outermost chromium alloy layer having a color space defined by CIELAB with a lightness L* significantly above 79, in this particular examples in the range from 81.0 to 83.4. In the context of the present invention, this is a desired brightness. The color channel a* was in the range from −0.6 to −0.3, and b* in the range from +0.7 to +1.4. OuL2 comprises, based on the total number of atoms in the outermost layer, 80 atom-% to 85 atom-% chromium, 6 atom-% to 7 atom-% carbon, 8 atom-% to 10.5 atom-% oxygen, 0.6 atom-% to 1.5 atom-% sulfur, and 0 atom-% iron. OuL2 is obtained from deposition composition DC2 (55° C., 5 A/dm$^2$, 5 minutes).

L*, a*, and b* values were determined by means of a photometer, Konica Minolta Spectrophotometer Cm-700d, with the parameters Color system: L*a*b*, Mode: SCI+SCE, Observer: 10°, light source: D65, illumination area 11 mm, measurement area 8 mm. The settings were chosen in such a way that a reference outermost layer obtained from hexavalent chromium comprising 90 atom-% chromium and 10 atom-% oxygen, based on the total number of atoms in the reference outermost layer, (without significant amounts of other elements) results in a L* value in the range from 84 to 85.

Optional Step (ii-a), Immersing the Substrate into an Immersion Solution (IS):

IS denotes a strongly acidic immersion solution with a pH of approximately 1.3, comprising, based on the total volume of the immersion solution, approximately 10 g/L trivalent chromium ions, approximately 83 g/L phosphate ions, and approximately 1.5 g/L malic acid. If applied, immersion was carried out for 10 seconds at a temperature of 25° C.

Step (ii), Providing an Aqueous, Acidic Passivation Solution (PS):

PS1 denotes an aqueous, acidic passivation solution with a pH of 3.5, comprising approximately 5 g/L trivalent chromium ions, approximately 14 g/L phosphate ions, and approximately 10 g/L oxalate anions. PS1 included dissolving chromium (III) phosphate, chromium (III) oxalate, and phosphoric acid (10 wt-%, based on the total weight of the passivation solution).

PS2 denotes an aqueous, acidic passivation solution almost identical to PS1, with the exception that the trivalent chromium ions were obtained by reducing hexavalent chromic acid with hydrogen peroxide in the presence of phosphoric acid and subsequent addition of oxalic acid.

Step (iii), Contacting the Substrate with the Passivation Solution:

Contacting in step (iii) was carried out for 30 to 60 seconds at 25° C. with an electrical current having a current density of 1 A/dm$^2$ and insoluble, mixed metal oxide coated anodes.

Kesternich Test Results:

The Kesternich test is designed to evaluate resistance against acid rain caused corrosion (also sometimes referred to as industrial atmosphere caused corrosion). It is a rapid corrosion test, which exposes a specimen to a condensation-water climate containing sulfur dioxide.

For each experiment (see experiment number "No." in the Table) 2 to 3 identical specimens were prepared and tested in three cycles, each cycle lasting for approximately 24 hours (8 hours at 40° C. followed by approximately 16 hours ambient conditions).

The Kesternich test was carried out in an apparatus from Liebisch KB300 (with a total volume of the test chamber of 300 liters) and in the "continuous exposure" mode based on ISO 6270-2 AHT. Thus, the controller was operating in AHT mode. The nominal sulfur dioxide concentration was 0.067 vol.-% obtained by adding 2.0 liters sulfur dioxide. Each specimen was positioned in the chamber and separated by each other by a distance of at least 20 mm. Prior to the start of the test, a total volume of 2 liters water with a conductivity of not more than 500 μS/m was put into the apparatus. A test was started and a test temperature of 40° C. was obtained within 1.5 hours after test start, and kept constant for another 6.5 hours, such that condensation water (sulfurous acid) was formed on the surface of the specimens. After said 8 hours (1.5 hours+6.5 hours) the test chamber was vented and allowed to cool down to ambient temperatures within 1.5 hours and allowed to remain in this state for another 14.5 hours (another 16 hours were thus obtained) to dry within the chamber. This cycle was repeated two times to obtain a total of three cycles.

Evaluation of optical deterioration was carried out after each cycle, wherein a final evaluation was carried out after the third cycle. The results of the final evaluation are given in the Table.

For the final evaluation the optical deterioration was categorized into one of the following two categories:

"passed", which denotes a significant resistance against corrosion and optical deterioration after the Kesternich test. The minimum requirement is that at least 80% of the total area of the outermost chromium alloy layer of a respective specimen is without optical deterioration.

"failed", which denotes that severe and inacceptable optical deteriorations are observed after the Kesternich test all over the outermost layer. This typically means that significantly less than 80% of the total area of the outermost chromium alloy layer of a respective specimen is without optical deterioration. This means in turn that 20% or more of the total area of the outermost chromium alloy layer exhibit recognizable, undesired optical deteriorations.

Optical deteriorations were evaluated by a panel of at least two skilled experts by means of visual inspection with the help of a stencil. Optical deterioration includes corrosion of the outermost layer, corrosion of the base-substrate or layers underneath the outermost layer as long as it is optically recognizable, as well as any sort of discoloration, including veils and blurs.

The invention claimed is:

1. A method for increasing corrosion resistance of a substrate comprising an outermost chromium alloy layer, the method comprising the steps of:

(i) providing the substrate comprising said outermost layer, the layer
having a color space defined by CIELAB with a lightness L* of 79 or more,
comprising oxygen and carbon, and
further comprising iron in a total amount of 0 atom-% to 1 atom-%, based on the total number of atoms in said outermost layer, (ii) providing an aqueous, acidic passivation solution, the solution comprising:
trivalent chromium ions,
phosphate ions, and
one or more than one organic acid residue anion, (iii) contacting the substrate with the passivation solution and passing an electrical current between the substrate as a cathode and an anode in the passivation solution such that a passivation layer is deposited onto the outermost layer, wherein in step (i) the outermost chromium alloy layer is electrolytically deposited from an aqueous, acidic deposition composition, the composition comprising:
trivalent chromium ions,
at least one organic acid comprising an isothiureido moiety and/or salts thereof, and
chloride ions in a total amount of 0 wt-% to 0.1 wt-%, based on the total weight of the deposition composition.

2. The method of claim 1, wherein in step (i) said outermost layer has a color space defined by CIELAB with a lightness L* of 80 or more.

3. The method of claim 1, wherein in step (i) said outermost layer has a color space defined by CIELAB with a color channel a* in the range from −2.0 to +2.0.

4. The method according to claim 1, wherein in step (i) said outermost layer has a color space defined by CIELAB with a color channel b* in the range from −4.0 to +4.0.

5. The method according to claim 1, wherein in step (i) in the outermost layer carbon is present in a total amount in the range from 2 atom-% to 10 atom-%, based on the total number of atoms in the outermost layer.

6. The method according to claim 1, wherein in step (i) in the outermost layer oxygen is present in a total amount in the range from 2 atom-% to 15 atom-%, based on the total number of atoms in the outermost layer.

7. The method according to claim 1, wherein in step (i) the outermost layer further comprises sulfur.

8. The method according to claim 1, wherein in the aqueous, acidic deposition composition of step (i) the at least one organic acid comprising an isothiureido moiety and salts thereof comprises at least one mono-carboxylic acid comprising an isothiureido moiety and/or salts thereof.

9. The method according to claim 1, wherein in the aqueous, acidic deposition composition of step (i) the at least one organic acid comprising an isothiureido moiety and salts thereof comprises the compound $(NH_2)C(=NH)S—(CH_2)_m—COOH$ and/or salts thereof, wherein m is an integer in the range from 1 to 10.

10. The method according to claim 1, wherein in the aqueous, acidic deposition composition of step (i) the at least one organic acid comprising an isothiureido moiety and salts thereof comprises the compound $(NH_2)C(=NH)S—(CH_2)_3—COOH$ and/or salts thereof.

11. The method according to claim 1, wherein in step (i) the aqueous, acidic deposition composition does not comprise one, more than one or all of the compounds selected from the group consisting of thiourea, thiosulfate, and ammonium ions.

12. The method according to claim 1, wherein in step (i) the aqueous, acidic deposition composition comprises the chloride ions in a total amount from 0 wt-% to 0.05 wt-%, based on the total weight of the deposition composition.

13. The method according to claim 1, wherein the one or more than one organic acid residue anion in the aqueous, acidic passivation solution of step (ii) comprises at least one organic acid residue anion having two carboxylic moieties.

14. The method according to claim 1, wherein in step (i) the outermost layer is free of cracks and free of pores.

15. The method according to claim 1, comprising prior to step (iii) the additional step (ii-a) immersing the substrate obtained after step (i) into an aqueous immersion treatment solution comprising:
trivalent chromium ions,
phosphate ions, and
one or more than one organic acid residue anion, wherein during the immersing no electrical current is applied.

* * * * *